US005656102A

United States Patent [19]

Taylor et al.

[11] Patent Number: 5,656,102

[45] Date of Patent: Aug. 12, 1997

[54] BAKE HARDENABLE VANADIUM CONTAINING STEEL AND METHOD THEREOF

[75] Inventors: Keith A. Taylor, Coplay; John G. Speer, Bethlehem, both of Pa.

[73] Assignee: Bethlehem Steel Corporation, Bethlehem, Pa.

[21] Appl. No.: 607,893

[22] Filed: Feb. 27, 1996

[51] Int. Cl.[6] ..... C22C 38/12; C21D 8/02

[52] U.S. Cl. ..... 148/320; 148/651; 148/603; 148/537; 148/534

[58] Field of Search ..... 148/651, 603, 148/320, 537, 534

[56] References Cited

U.S. PATENT DOCUMENTS

| | | | |
|---|---|---|---|
| 1,420,328 | 6/1922 | McConnell . | |
| 1,546,176 | 7/1925 | Mathesius et al. . | |
| 2,291,842 | 8/1942 | Strauss | 75/58 |
| 2,999,749 | 9/1961 | Saunders et al. | 75/58 |
| 3,375,105 | 3/1968 | Lynch | 75/129 |
| 3,600,160 | 8/1971 | Simcoe et al. | 75/123 J |
| 3,897,280 | 7/1975 | Gondo et al. | 148/12 C |
| 3,947,293 | 3/1976 | Koji et al. | 148/12 F |
| 4,050,959 | 9/1977 | Kenji et al. | 148/12.3 |
| 4,144,378 | 3/1979 | Kim | 428/653 |
| 4,313,770 | 2/1982 | Takahashi et al. | 148/12 C |
| 4,375,376 | 3/1983 | Rowden et al. | 148/12 F |
| 4,391,653 | 7/1983 | Takechi et al. | 148/12 C |
| 4,398,970 | 8/1983 | Marder et al. | 148/12 F |
| 4,496,400 | 1/1985 | Irie et al. | 148/12 C |
| 4,750,952 | 6/1988 | Sato et al. | 148/320 |
| 4,909,861 | 3/1990 | Muraoka et al. | 148/12.7 A |
| 5,123,969 | 6/1992 | Chou | 148/547 |
| 5,133,815 | 7/1992 | Hashimoto et al. | 148/319 |
| 5,139,580 | 8/1992 | Freler et al. | 148/547 |
| 5,279,683 | 1/1994 | Okada et al. | 148/546 |
| 5,556,485 | 9/1996 | Taylor et al. | 148/547 |

FOREIGN PATENT DOCUMENTS

| | | | |
|---|---|---|---|
| 0572666 | 8/1993 | European Pat. Off. | C22C 38/14 |
| 57-140868 | 8/1982 | Japan | 148/320 |
| 246327 | 11/1986 | Japan . | |
| 194126 | 7/1990 | Japan . | |
| 4218618 | 8/1992 | Japan . | |
| 246153 | 9/1992 | Japan . | |
| 2234985 | 2/1991 | United Kingdom . | |

OTHER PUBLICATIONS

Scripta Metallurgica et Materialia, vol. 32, No. 1, pp. 7–12, 1995, "Solubility Products For Titanium–, Vanadium–, and Niobium–Carbide in Ferrite", Keith A. Taylor.

Comm. Eur. Communities Report, EUR Rep. #9968, 1986. Abstract of a report directed to continuous annealing of precipitation strengthened low carbon steels.

Stahl u. Esin 113 (1993) nr. 10 "Bake–Hardening—A Possibility of Increasing the Yield Strength of Sheet Steel", Patrick Eisen and Hans Paul Houghardy.

Iron and Steelmaking, vol. 21, No. 3, 1994, "Ferrous Metallurgy at the University of Leeds", Terry Gladmann. See p. 171, Interstitial free steels.

Kawasaki Steel Tech. Rpt. #27 Nov. 1992, "Development of Bake–Hardening High Strength Cold Rolled Sheet Steels for Automotive Exposed Panels" S. Satoh, et al.

SAE Tec. Paper Series Feb. 25, 1991 "Development of a New Bake–Hardenable Galvannealed Sheet Steel for Automotive Exposed Panels" T. Tanioku, et al.

Tetsu–to–Hagane, vol. 79, 1993, pp. 76–82. "Bake Hardenability of Cold Rolled Ti–Bearing Extra Low Carbon Sheet Steels due to Precipitation Control", K. Kawasaki, et al.

*Primary Examiner*—Deborah Yee

*Attorney, Agent, or Firm*—Harold I. Masteller

[57] ABSTRACT

Rolled articles such as hot rolled or cold rolled and annealed sheet and/or strip include effective amounts of vanadium in low carbon steels to produce an improved bake hardenable product especially adapted for automotive use. The use of vanadium in the alloy steel chemistry controls bake hardenability, permits solution annealing at lower temperatures in its manufacturing sequence and specifies a composition range which is more easily cast within desired limits and causes less variation in final mechanical properties. Controlling the vanadium to carbon ratio to maintain a value of about 10 or greater also improves aging resistance.

36 Claims, 1 Drawing Sheet

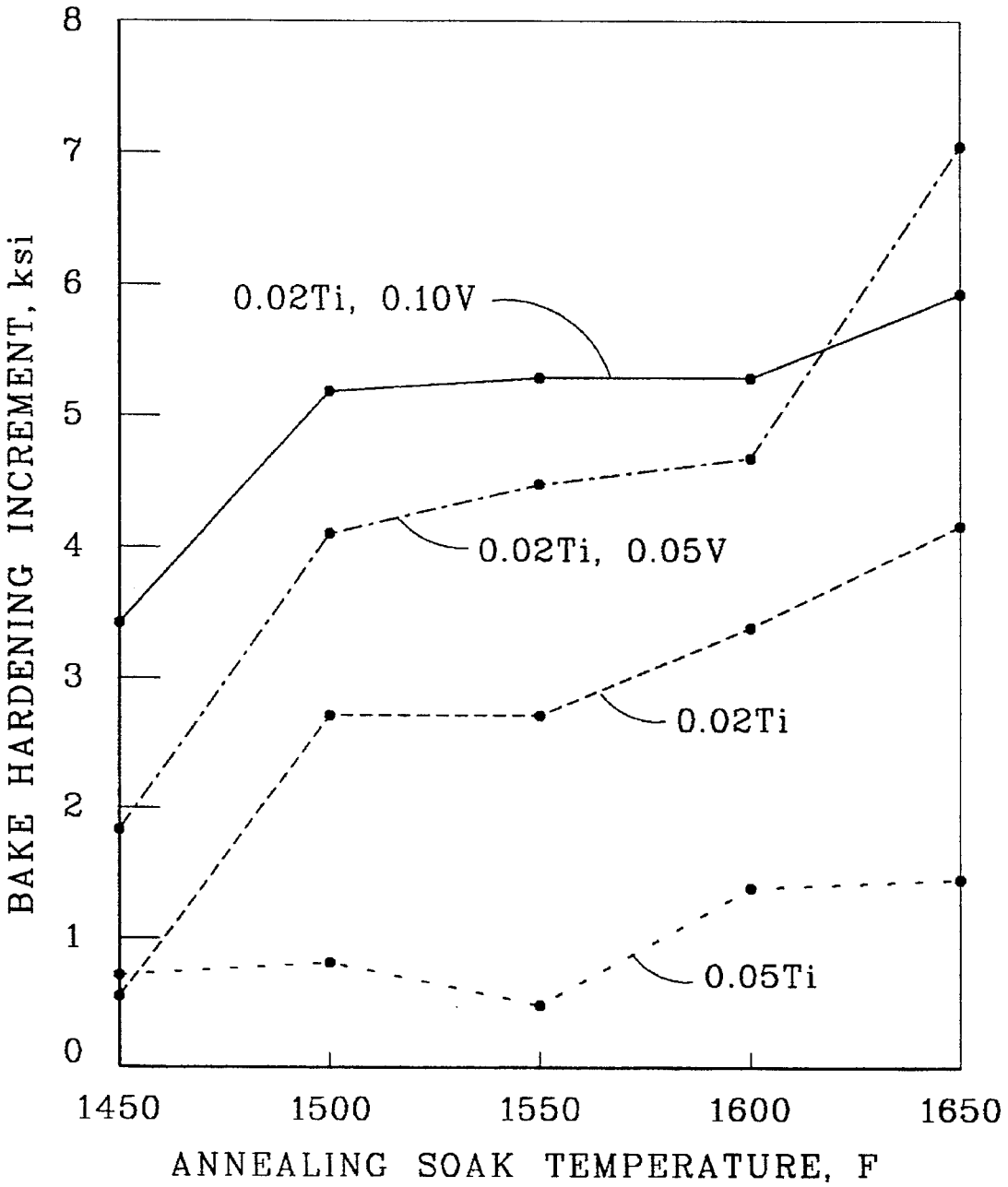
8
7
6
5
4
3
2
1
0
BAKE HARDENING INCREMENT, ksi
0.02Ti, 0.10V
0.02Ti, 0.05V
0.02Ti
0.05Ti
1450
1500
1550
1600
1650
ANNEALING SOAK TEMPERATURE, F

BAKE HARDENABLE VANADIUM CONTAINING STEEL AND METHOD THEREOF

FIELD OF THE INVENTION

The present invention is directed to a low carbon steel strip product and method for making which has improved bake hardenability properties and, in particular, a steel strip product having controlled amounts of vanadium.

BACKGROUND ART

In the prior art, there has been an ever increasing demand, particularly by automobile manufacturers, for higher strength steel sheet and strip to provide both dent resistance and weight reduction in new automobile vehicle designs. With this desire, an increasing demand is seen for steels which are highly formable but also exhibit bake hardenability. As is well known in the art, bake hardenability refers to the strengthening that occurs in certain steels during the automotive paint baking treatment, typically around 350° F. for 20 or 30 minutes. During the paint baking or other suitable treatment, a bake hardenable steel is strengthened to provide the desired dent resistance in the final product.

The attributes of ductility and strength are at conflict in a given steel. To achieve good formability (such as press formability or press shapability), the steel must be ductile in nature to be formed into the desired shape. Along with this ductility, however, the steel must also retain sufficient strength to resist denting when used in exposed panels such as those found in automobiles.

The prior art has proposed various solutions to overcome this conflict through the control of the steel alloying components as well as the process used for manufacturing the steel product. Bake hardenability is an attractive attribute contributing to these solutions because such hardening occurs after forming.

U.S. Pat. No. 5,133,815 to Hashimoto et al. discloses a cold-rolled or hot-dipped galvanized steel sheet for deep drawing. Bake hardenability is improved by control of the alloying steel components and a carburization step to obtain the proper concentration of solute carbon in the steel sheet.

U.S. Pat. No. 4,391,653 to Takechi et al. discloses a high strength cold-rolled strip having improved bake hardenability as a result of controlling the nitrogen content of the cold-rolled strip.

U.S. Pat. No. 4,496,400 to Irie et al. relates to cold-rolled steel sheets suitable for external automotive sheet. This patent discloses an effective compounding amount of niobium, which acts to fix C and N in the steel in the presence of a proper amount of aluminum and an annealing condition capable of developing effectively the contribution of niobium. Continuous annealing of this steel requires a detailed heating and cooling regimen to obtain the bake hardening effect.

U.S. Pat. No. 4,750,952 to Sato et al. also discloses a cold-rolled steel sheet having improved bake hardenability. In this patent, the amount of sulfur and nitrogen is limited and the addition of titanium is restricted to a specific range in consideration of the sulfur and nitrogen amounts. This patent also requires "time/energy intensive" annealing (i.e. greater than 300 seconds above recrystallization temperatures).

For automotive skin panel applications, coated steels such as hot dipped steels are preferred for their corrosion resistance. However, alloys especially suited for hot-dipped coating often have compositions which render them generally interstitial-free (IF). In these types of alloys, the alloying components effectively remove all of the carbon from solution which precludes bake hardenability.

Thus, a need has developed to provide improved methods and alloy chemistries which permit the manufacture of hot-dipped coated products which have both acceptable formability and bake hardenability properties. Further, in view of the need for precise chemistry controls with steel compositions utilizing alloying components such as titanium and/or niobium, a need has developed to provide an alloy chemistry suitable for bake hardening which does not require precise and extremely low alloy component limits and energy intensive processing requirements.

Responsive to this need, the present invention provides an improved hot-rolled or cold-rolled and annealed low carbon steel product suitable for sheet applications such as automotive sheet which has an alloy chemistry which is more easily controlled than prior art chemistries and also has less energy intensive and less demanding processing requirements.

SUMMARY OF THE INVENTION

It is a first object of the present invention to provide a low carbon steel strip and sheet which has excellent bake hardenability (in combination with suitable aging resistance prior to forming), and is especially adapted for use in automobile manufacture.

Another object of the present invention is to provide a method of making a hot-rolled or cold-rolled and annealed strip and/or sheet product having improved flatness and which is less energy intensive by an alloy chemistry which permits lower annealing temperatures to achieve final product qualities.

Other objects and advantages of the present invention will become apparent as a description thereof proceeds.

In satisfaction of the foregoing objects and advantages, the present invention, in its broadest embodiment is concerned with hot-rolled or cold-rolled and annealed articles and methods of making these articles. More preferably, the steel is either continuously or batch annealed and coated by techniques such as hot-dip coating or electrogalvanizing for use in automobile sheet or plate.

The present invention is an improvement over the prior art method of making hot-rolled or cold-rolled and annealed articles by the steps of casting carbon steel containing effective amounts of carbon, manganese, aluminum, nitrogen with the balance iron and incidental impurities wherein the cast steel is subsequently hot-rolled and cooled, and may then be cold-rolled to gauge and annealed in a selected temperature range. According to the invention, the steel has a composition consisting essentially in weight percent of between 0.0005 and less than 0.1% carbon, between zero and less than 0.04% nitrogen, between zero and less than 0.5% titanium, between zero and 0.5% aluminum, between zero and up to 2.5% manganese, between 0.005 and 0.6% vanadium with the balance iron and incidental impurities.

The vanadium addition contributes to improved bake hardenability properties of the cold-rolled and annealed articles. Moreover, the wide permissible weight percentage range of vanadium makes it easier to cast a steel within tolerances and provides a product which has final mechanical properties which are relatively insensitive to variations in the vanadium content.

The inventive alloy chemistry contributes to improved bake hardenability when the steel article is subjected to paint baking. Bake hardenability can be controlled by the use of vanadium within the prescribed ranges.

In another aspect of the invention, a rolled steel article, e.g. a hot-rolled or cold-rolled and annealed article, is provided consisting essentially in weight percent of between 0.0005 and 0.1% carbon, between zero and less than 0.04% nitrogen, between zero and less than 0.5% titanium, between zero and 0.5% aluminum, between zero and up to 2.5% manganese, between 0.005 and 0.6% vanadium with the balance iron and incidental impurities. Preferably, the steel consists essentially in weight percent of between 0.0005 and 0.01% carbon, between zero and less than 0.008% nitrogen, between zero and less than 0.05% titanium, between zero and 0.10% aluminum between zero and up to 1.0% manganese, between 0.01 and 0.15% vanadium with the balance iron and incidental impurities. The inventive cold-rolled and annealed article can be coated in any conventional fashion such as hot-dipping or electrogalvanizing. The inventive steel article exhibits improved bake hardenability as a result of the vanadium addition and provides a steel article with improved shape and an alloy chemistry more easily controlled during melting and casting.

The inventive alloy chemistry also permits lower solution annealing temperatures than prior art alloys and lower energy costs associated with its manufacture.

In another aspect of the invention, the aging resistance of these types of steels is improved by controlling the vanadium/carbon ratio to at least 10 or greater than 10.

BRIEF DESCRIPTION OF THE DRAWINGS

Reference is now made to the sole drawing of the invention wherein a graph depicts the relationship between bake hardenability in KSI and solution annealing temperatures for the invention.

DESCRIPTION OF THE PREFERRED EMBODIMENTS

It has been discovered that a low carbon steel can be modified with effective amounts of vanadium to produce a bake hardenable hot-rolled or cold-rolled and annealed article especially suitable for automotive sheet in a coated condition.

The inventive alloy chemistry achieves desirable bake hardenability properties at lower solution annealing temperatures and is more "producer friendly" during article manufacture. That is, using vanadium in the prescribed amounts in the alloy steel chemistry makes it easier to cast the steel within tolerances so as to produce an acceptable product. The weight percentage of vanadium extends to levels higher than other prior art alloying components and is more easily controlled during casting. Moreover, the inventive alloy chemistry is less prone to wide variations in the final mechanical properties, since typical variations in vanadium content do not greatly alter the mechanical properties.

In its broadest embodiment, the invention comprises a bake hardenable hot-rolled or cold-rolled and annealed steel article such as a sheet or strip of the low carbon type. The rolled steel article consists essentially in weight percent of between 0.0005 and 0.1% carbon, between zero and less than 0.04% nitrogen, between zero and less than 0.5% titanium, between zero and 0.5% aluminum, between zero and up to 2.5% manganese, between 0.005 and 0.6% vanadium with the balance iron and inevitable impurities. Preferably, carbon is up to 0.01%, nitrogen is up to 0.008%, titanium is up to 0.05% and vanadium is up to 0.15%.

The addition of manganese in these types of steel is conventional as manganese acts as both a strengthening element and combines with sulfur to prevent red-shortness of the steel.

Since the hot-rolled or cold-rolled and annealed steels of the invention are killed steels, aluminum is contained therein for its deoxidation effect. Preferably, the aluminum is limited to 0.08%.

Nitrogen, as stated above, has an upper limit of 0.04% (400 ppm). Preferably, the nitrogen is limited to less than 0.008%.

The low carbon steel of the invention requires a finite amount of carbon in order to achieve the bake hardenability effect. Generally, this lower limit is around 0.0005% carbon (5 ppm). The upper limit is preferably 0.005%.

Although silicon and phosphorous in these types of low carbon steels are often at residual impurity levels, other specific end uses of the steel product may require higher additions to achieve higher levels of strength. Thus, depending on the final use, silicon and phosphorus could be added separately or in combination in amounts up to 1.0% and 0.25% by weight, respectively. Other elements may also contribute to solution strengthening, but Mn, P, and Si are typically used in low carbon sheet steels for this purpose.

Titanium is added to the steel mainly to remove solute nitrogen though formation of nitrogen compounds such as titanium nitride. This allows control of bake hardenability simply by controlling the level of solute carbon. Preferably, the titanium level should be at least 3.4 times the weight percent concentration of nitrogen. It should be understood that other strong nitride-forming elements, such as boron, zirconium, or even aluminum or vanadium in suitable levels with proper processing, may be substituted for titanium to combine with solute nitrogen.

Sulfur is not normally added to low carbon sheet steels, but is present in residual amounts which depend on the steelmaking and ladle treatment methods employed. Sulfur in the final product may be typically found in the form of various compounds, including titanium sulfide (TiS). With the above consideration relating to titanium nitride formation, and recognizing that some titanium may react with sulfur to form TiS, the preferred level of titanium is between 3.4N and (3.4N+1.5S), where N and S are the weight percent concentrations of nitrogen and sulfur, respectively.

Vanadium is also added to control bake hardenability of the hot-rolled or cold-rolled and annealed steel articles. The vanadium preferably ranges between 0.03 and 0.12% and more preferably 0.05 and 0.10%.

As will be shown below, vanadium additions can control bake hardenability and aging resistance, such control not heretofore recognized in the prior art. For certain alloy chemistries according to the invention, increases in bake hardenability have been shown with the addition of vanadium.

The inventive cold-rolled and annealed steel can be subsequently processed into a coated steel and press formed into various shapes for any end use. In particular, these coated products are especially adapted for use as automotive sheet or plate wherein the coated product is subsequently painted and baked to achieve the bake hardenability effect and dent resistance in a vehicle's exposed panels. The coating may be any conventional coating typically used in these types of application such as zinc.

In another aspect of the invention, the inventive steel chemistry provides improvement in prior art techniques of cold-rolling and annealing these types of materials. In these prior art processes, a particular steel is cast into either ingot form or continuously cast into slab and hot-rolled and cooled into coil form. The hot-rolled products can be used or, alternatively, the coil form is subsequently cleaned, e.g., pickled, and cold-rolled in a number of passes to a desired gauge. The cold-rolled steel is then annealed, either in batch form or in a continuous fashion to produce a recrystallized steel article.

These processes also can include coating the cold-rolled and annealed product by techniques such as electrogalvanizing or hot-dip coating. These coating steps can be done as part of the annealing. The invention provides improvements over prior art processes in that the inventive alloy steel chemistry described above permits lower solution annealing temperatures to be utilized, particularly during continuous annealing, than prior art alloying chemistries. For example, in U.S. Pat. No. 4,496,400 to Irie et at., a niobium-containing bake hardenable thin steel sheet is annealed at a minimum of 900° C. (1,652° F.).

In contrast, attractive bake hardenability can be achieved with the inventive alloy chemistry at annealing temperatures above about 1450° F. (788° C.). This lower annealing temperature also results in energy savings during annealing and a lower product unit cost, as well as better control of product shape and flatness.

The use of vanadium in the inventive alloy chemistry permits lowering of the solution annealing temperature because vanadium is more soluble in the steel matrix than alloying components such as titanium or niobium. Consequently, lower solution annealing temperatures can be used for achieving the necessary level of carbon in solute form for bake hardenability.

The effective annealing temperature range can be as low as around 1,450° F. and up to about 1,650° F. Preferably, the solution annealing treatment is within the range of 1,500° to 1,550° F. to achieve both adequate recrystallization, bake hardenability, improved product shape/flatness and lower energy costs.

It should be understood that the processing steps of casting, hot rolling and cooling and cold-rolling are well known in the metallurgical arts for these types of low carbon steels and a further detailed description thereof is not deemed necessary for understanding of the invention.

In order to demonstrate the unexpected results associated with the use of vanadium in these types of low carbon steels, the following experiments were conducted. It should be noted that all percentages are in weight percent unless otherwise indicated. Experiments are included for illustration purposes and are not considered to be limiting as to the invention.

Three 500 pound experimental heats were cast into ingot form under laboratory conditions and subsequently hot-rolled to a thickness of 0.75 inches. The compositions of the heats were nominally 0.003% carbon—0.2% manganese—0.004 to 0.007% nitrogen—0.02 to 0.04% aluminum—0.02% titanium and selected amounts of vanadium with the balance iron and impurities.

The hot-rolled ingots were heated to 2,300° F. and further rolled from 0.75 inches to 0.12 inches. In order to simulate water-spray run-out table cooling after hot-rolling, the rolled ingots where quenched in a polymer solution until a conventional coil cooling temperature was reached. At this point, the hot-rolled samples were furnace-cooled to ambient temperature.

Each hot-rolled sample was then pickled and cold-rolled from 0.12" to 0.03" in a plurality of passes to achieve about a 75% cold reduction.

The cold-rolled material was then subjected to annealing at temperatures between 1,450° and 1,650° F. for times of thirty seconds followed by air cooling and temper rolling (cold reduction of about 1%). The temper-rolled steel was subjected to a standard bake hardening simulation, consisting of 2% tensile prestrain followed by treatment at 350° F. for 30 minutes. The bake hardenability increment represents the difference between the yield stress after aging and the 2% flow stress prior to aging. The material was also subjected to strain aging index (SAI) testing involving prestraining of 10% followed by treatment at 212° F. for 60 minutes, to provide an initial indication of the room-temperature aging resistance of the processed steel.

The following table summarizes the actual compositions in weight percents for the experiment.

TABLE I

| Steel* | C | Mn | Al | N | Ti | V |
|---|---|---|---|---|---|---|
| 0.02Ti | 0.0018 | 0.20 | 0.024 | 0.0044 | 0.018 | — |
| 0.02Ti—0.05V | 0.0021 | 0.19 | 0.038 | 0.0062 | 0.021 | 0.049 |
| 0.02Ti—0.10V | 0.0028 | 0.19 | 0.040 | 0.0065 | 0.021 | 0.094 |

*Balance iron and residual impurities

With reference now to the drawing, a comparison is shown between bake hardening increments and annealing soak temperature for four different alloy chemistries. The three curves showing 0.02 titanium correspond to the three chemistries identified in the table. The curve showing 0.05 titanium is representative of an excess stabilized low carbon steel sheet which is adaptable for hot-dipping but does not exhibit significant bake hardenability.

As is clearly evident from the drawing, vanadium additions can be used to control bake hardenability in a low carbon steel. The graph shows that adding an amount of vanadium to a titanium containing low carbon steel, for example 0.05% vanadium, improves bake hardenability properties at annealing temperatures above 1,500° F. up to about 1600° F. as compared to similar compositions shown without vanadium additions. The graph further shows that even more improved bake hardening properties can be achieved when the vanadium additions are increased up to about 0.10%. And finally, the graph shows that improved bake hardening properties also occur in low carbon vanadium steels at lower annealing temperatures, below a preferred 1500° F. to 1550° F. annealing range. Bake hardenability is increased up to a range of about 2 KSI to about 5 KSI as compared to a range of about less than 1 KSI to about 2.5 KSI for non-vanadium containing steels at these lower annealing temperatures. Furthermore, the results of testing for strain-aging index indicated that these steels exhibit sufficient resistance to aging at ambient temperature prior to forming.

In another aspect of the invention, it has been discovered that controlling the vanadium to carbon ratio in the compositions of the vanadium-bearing steels described above produces unexpected improvements in aging resistance. More particularly, maintaining the vanadium to carbon ratio of about 10 or above for these types of steels achieves the resistance to aging described above. It is believed that a broad range of vanadium, i.e., between about 0.005% and less than about 0.6%, as described above, will result in improved aging resistance provided the vanadium and carbon contents are selected to maintain a vanadium/carbon ratio of 10 or above. More preferably, the vanadium lower limit is set at 0.02%. It is believed that the vanadium upper limit is determined by a decrease in bake hardenability to an unacceptable level.

Referring to the Table 2 below, comparative data is provided showing aging resistance in terms of yield point elongation (YPE) for 9 specific compositions. The chemistries of these 9 compositions are also provided below.

The resistance to room-temperature aging was determined by measuring the amount of yield-point elongation (YPE) that is observed after an accelerated aging test (212° F./one hour). A steel is said to be essentially non-aging if there is no significant evidence of YPE after aging, i.e., if the YPE is less than about 0.2%. Our test results indicate that a critical V/C ratio (expressed in terms of weight percentages) of about 10 or more will ensure that the steel is sufficiently aging-resistant over at least the preferred annealing temperature of 1450°–1550° F., and more preferably 1500°–1550° F.

in the laboratory, steel samples were sealed in a stainless steel can through which a gas mixture of 4% hydrogen/96% nitrogen was passed, heated at a rate of 50° F. per hour to a temperature of 1,300° F., held at 1,300° F. for 15 hours, then cooled at a rate of 50° F. per hour to ambient.

Tables 3 and 4 depict bake hardening properties after simulated batch annealing and production trial batch annealing, respectively for compositions falling within the broad ranges discussed above. As evident from the tables, and quite surprisingly, these steels exhibit bake hardenability.

TABLE 2

| Designation | Composition (wt. %) (balance Fe and residual impurities) | | | | | | | | | YPE (%) Data* Annealing Soak Temp. (°F.) | | |
|---|---|---|---|---|---|---|---|---|---|---|---|---|
| No. | C | Mn | P | S | Ti (or B) | Al | V | N | V/C | 1450° | 1500° | 1550° |
| 1 | 0.0053 | 0.20 | 0.015 | 0.008 | 0.022 | 0.031 | 0.051 | 0.0035 | 9.6 | 0 | 0.1 | 1.51 |
| 2 | 0.009 | 0.20 | 0.016 | 0.008 | 0.022 | 0.033 | 0.050 | 0.0042 | 5.5 | 4.28 | 4.12 | 5.54 |
| 3 | 0.020 | 0.21 | 0.014 | 0.008 | 0.021 | 0.048 | 0.047 | 0.0068 | 2.4 | 1.77 | 1.32 | 1.42 |
| 4 | 0.0044 | 0.20 | 0.014 | 0.008 | 0.023 | 0.024 | 0.022 | 0.0039 | 5 | 0 | 0 | 1.16 |
| 5 | 0.0094 | 0.20 | 0.016 | 0.007 | 0.024 | 0.045 | 0.076 | 0 0056 | 8.1 | | 3.9 | 3.8 |
| 6 | 0.0034 | 0.21 | 0.016 | 0.008 | 0.021 | 0.018 | 0.14 | 0.0034 | 41.2 | 0 | 0 | 0 |
| 7 | 0.0030 | 0.20 | 0.016 | 0.009 | 0.022 | 0.040 | 0.19 | 0.0045 | 63.3 | 0 | 0 | 0 |
| 8 | 0.0024 | 0.20 | 0.053 | 0.009 | 0.022 | 0.034 | 0.050 | 0.0057 | 20.8 | 0 | 0 | 0 |
| 9 | 0.0034 | 0.20 | 0.015 | 0.011 | 0.018 Ti 0.0002B | 0.014 | 0.050 | 0.0051 | 14.7 | 0 | 0 | 0 |

*All Steels Temper Rolled and Aged 212° F./1 hr.

As is evident from this table, minimal yield point elongation is achieved for compositions having vanadium to carbon ratios of 10 or above. It should be understood that the compositions depicted in the yield point elongation table are also baked hardenable in accordance with the disclosure of this application and the compositional limits and processing conditions described above.

The level of interstitial solute is an important parameter affecting aging behavior. In general, elements which readily combine chemically with carbon or nitrogen tend to reduce the level of solute carbon and, hence, the magnitude of the age-hardening or yield point elongation. In the present invention, vanadium, which is known to react with carbon in steels to form vanadium carbide, is used to control the level of solute carbon and provide a suitable degree of bake hardening while maintaining resistance to room temperature aging. The degree to which vanadium will combine with carbon is found to be expressed by the ratio of the concentrations of vanadium and carbon, V/C. It is hypothesized that the V/C concentration ratio is a parameter which is important in capturing the solubility (or, conversely, the stability) of vanadium carbides and, therefore, controls the solute carbon level (according to the ratio V/C). That is, carbide stability is determined by both V and C together, rather than individually.

In another aspect of the invention, compositions falling within the broad ranges discussed above were subjected to simulated batch or box annealing conditions to determine whether these compositions exhibited bake hardenability.

Box annealing involves placing a cover over one or more stacked coils, introducing a protective atmosphere, and heating so as to achieve a temperature within a prescribed range throughout the coil and thereby effect complete recrystallization. Typically, this range might be about 1,200° to 1,400° F. Because of the potentially large masses of steel involved in coil form, heating and cooling rates are relatively low, typically about only 50° F. per hour with a cycle time on the order of a few days. To simulate box annealing Because of the slow cooling rates in box annealing, which are favorable for carbide precipitation, strain aging is not generally expected to be a problem. Bake hardenability is somewhat unexpected or surprising, however, and it is hypothesized that vanadium offers carbide solubility and precipitation behavior that lead to the results reported here.

The improved bake hardenability and aging resistance of the inventive alloy steel chemistry, the lower solution annealing temperatures, the improved sheet or strip shape and flatness, the ability to easily control the vanadium addition during casting and the reduced sensitivity between vanadium content variations and final mechanical properties makes this steel ideal for use in sheet and/or strip products either in the hot-rolled or cold-rolled and annealed state or as a coated product.

TABLE 3

Bake Hardening Properties After Simulated Batch Annealing

| | | Temper Rolled (1% aim) | |
|---|---|---|---|
| Designation No. | Steel Type | BHI (ksi) 2% Prestrain | SAI (ksi) |
| * | Ti—V | 3.5 | 0 |
| ** | Ti—0.10V | 2.4 | 0 |
| 6 | Ti—0.15V | 0.9 | 0 |
| 1 | 0.005C—Ti—V | 0.6 | 0 |
| 8 | Ti—V—P | 1.5 | 0 |
| *** | 0.7Mn—Ti—V | 1.3 | 0 |
| 9 | Ti—V—B | 2.6 | |

*Composition coresponds to 0.02Ti—0.05V in Table 1.
**Composition corresponds to 0.02Ti—0.10V in Table 1.
***0.0023 C, 0.71 Mn, 0.015 P, 0.009 S, 0.021 Ti, 0.028 Al, 0.053 V, 0.004 N, balance Fe impurities.

TABLE 4

| Batch-Annealed Ti + V Production Trial (All testing at Center-of-width) | | |
|---|---|---|
| Designation | Bake-Hardening, ksi after* | |
| No. | 0% Prestrain | 2% Prestrain |
| 10 | 2.1 | 4.1 |
| 11 | 1.85 | 3.7 |

10 Chemistry — H 0.0067 C, 0.14 Mn, 0.062 P, 0.026 Al, 0.0043 N, 0.020 Ti, 0.047 V, T 0.0054 C, 0.14 Mn, 0.062 P, 0.027 Al, 0.0038 N, 0.021 Ti, 0.047 V.

11 Chemistry — H 0.0058 C, 0.12 Mn, 0.064 P, 0.028 Al, 0.0057 N, 0.025 Ti, 0.053 V, T 0.0055 C, 0.13 Mn, 0.066 P, 0.033 Al, 0.0044 N, 0.026 Ti, 0.051 V.

*Bake Hardening KSI values are averages of H and T samples, H and T represent head and tail of coil.

Given the improvements over conventional interstitial free steels and "producer friendly" characteristics of the inventive rolled article and method of making, the steel is especially suited for hot-dipped coating processes such as galvannealing or the like.

The cold-rolled and annealed steel article employing the inventive alloy steel chemistry can be hot-dipped coated in any conventional fashion, preferably in a continuous annealing hot-dipped coating line. Once hot-dipped coated, the coated steel article can be formed in conventional fashion into automotive panels. The panels are easily formed and are subsequently painted and baked, the painted panels showing good dent resistance.

As such, an invention has been disclosed in terms of preferred embodiments thereof which fulfill each and every one of the objects of the present invention as set forth hereinabove and provides an improved low carbon steel article and method of manufacturing which utilizes vanadium as an alloying component for improved bake hardenability and lower energy consumption during manufacture.

Of course, various changes, modifications and alterations from the teaching of the present invention may be contemplated by those skilled in art without departing from the intended spirit and scope thereof. Accordingly, it is intended that the present invention only be limited by the terms of the appended claims.

We claim:

1. In a method of making a rolled steel article comprising the steps of casting a low carbon steel containing amounts of carbon, manganese, aluminum, nitrogen with the balance iron and incidental impurities and hot rolling said steel, the improvement comprising:

a) providing said steel with a composition consisting essentially in weight percent of:
between 0.0005 and 0.1% carbon;
between zero and less than 0.015% nitrogen;
between zero and less than 0.05% Ti as a nitride forming element;
between zero and 0.5% aluminum;
between zero and up to 2.5% manganese;
between 0.005 and 0.6% vanadium;
the balance iron and inevitable impurities, b) maintaining a vanadium/carbon ratio of about 10 or above in said steel, and c) cold rolling the hot rolled steel and batch annealing the cold rolled steel in a coil form at a selected temperature range, holding the coil at said selected temperature for a period of time and slowly cooling the coil to ambient temperature.

2. The method of claim 1 wherein said selected temperature range is between about 1,200° F. and 1,400° F.

3. The method of claim 1 wherein said vanadium ranges between 0.05 and 0.15%.

4. The method of claim 1 wherein bake hardenability is increased by at least 3 KSI from said vanadium addition.

5. The method of claim 1 wherein said steel consists essentially of by weight 0.0018 to 0.0028% carbon, 0.18–0.22% manganese, 0.024–0.040% aluminum, 0.0044 to 0.0065% nitrogen, 0.018–0.022% titanium as said nitride forming element, and 0.049–0.094% vanadium with the balance iron and inevitable impurities.

6. The method of claim 1 wherein said steel is coated.

7. The method of claim 6 wherein said steel is coated by hot-dipping.

8. The method of claim 6 wherein said steel is coated by electrogalvanizing.

9. The method of claim 1 wherein said steel is formed into a sheet product and subjected to a paint baking step.

10. The method of claim 1 wherein said carbon ranges between 0.001 and 0.01%, said nitrogen ranges between 0.001 and 0.005%, said vanadium ranges between 0.03 and 0.12%, said aluminum ranges between 0.02 and 0.08% and titanium as said nitride-forming element is in an amount greater than 3.4× said nitrogen amount.

11. A method of producing an article of vanadium-containing low carbon sheet steel comprising the steps of improving aging resistance by:

a) providing the vanadium-containing low carbon sheet steel with amounts of carbon, vanadium and a nitride forming element so that the vanadium-containing low carbon sheet steel has bake hardening capability, said steel consisting essentially of by weight percent:
0.0005 to less than 0.1% carbon;
between zero and up to 2.5% manganese;
between zero and up to 0.5% aluminum;
between zero and less than 0.015% nitrogen;
between zero and up to 0.05% Ti as a nitride forming element;
between 0.005 and less than 0.6% vanadium;
the balance iron and incidental impurities, and b) maintaining a vanadium/carbon ratio of about 10 or above in said steel to improve aging resistance.

12. The method of claim 11 wherein said vanadium ranges between about 0.02 and 0.6% by weight.

13. The method of claim 11 wherein said vanadium ranges between about 0.05 and about 0.20% by weight.

14. A rolled steel article consisting essentially of by weight percent:
0.0005 to less than 0.1% carbon;
between zero and up to 2.5% manganese;
between zero and up to 0.5% aluminum;
between zero and up to 0.05% Ti as a nitride-forming element;
between zero and less than 0.015% nitrogen;
between 0.005 and less than 0.6% vanadium;
the balance iron and incidental impurities, wherein said article exhibits improved aging resistance when a ratio of vanadium to carbon is about 10 or above.

15. The rolled steel article of claim 14 wherein said ratio of vanadium to carbon is about 10 up to about 64.

16. The rolled steel article of claim 14 wherein said vanadium ranges between 0.02 and 0.6% by weight.

17. The rolled steel article of claim 16 wherein said vanadium ranges between about 0.05 and about 0.20% by weight.

18. The rolled steel article of claim 14, wherein said carbon is up to 0.0034% and vanadium is between 0.05% and less than 0.6%.

19. The method of claim 11, wherein carbon is up to 0.0034% and vanadium is between 0.05% and less than 0.6%.

20. A method of producing an article of vanadium containing low carbon sheet steel comprising the steps of improving aging resistance by:

a) providing the vanadium-containing low carbon sheet steel with amounts of carbon, vanadium and a nitride forming element selected from the group consisting of titanium, boron and zirconium so that the vanadium-containing low carbon sheet steel has bake hardening capability, said steel consisting essentially of by weight percent:
0.0005 to less than 0.1% carbon;
between zero and up to 2.5% manganese;
between zero and up to 0.5% aluminum;
between zero and less than 0.04% nitrogen;
between 0.005 and less than 0.6% vanadium;
the balance iron and incidental impurities, b) maintaining a vanadium/carbon ratio of about 10 or above in said steel to improve aging resistance, and c) adding said nitride-forming element in an amount between zero and less than 0.5% to cause a reaction so that free nitrogen is removed from said steel, and so that a finite amount of carbon remains in solution at completion of said reaction wherein, when titanium is selected as of the nitride-forming element, the amount satisfies the relationship $3.4N<Ti<6(N+C)$.

21. The method of claim 20 wherein said nitride-forming element is selected from one of boron and zirconium.

22. The method of claim 20 wherein said nitride-forming element is titanium.

23. A rolled steel article consisting essentially of by weight percent:

0.0005 to less than 0.1% carbon;

between zero and up to 2.5% manganese;

between zero and up to 0.5% aluminum;

between zero and less than 0.04% nitrogen;

between 0.005 and less than 0.6% vanadium;

the balance iron and incidental impurities;

maintaining a vanadium/carbon ratio of about 10 or above in said steel to improve aging resistance; and a nitride-forming element selected from the group consisting of titanium, boron and zirconium in an amount between zero and less than 0.5% to cause a reaction so that free nitrogen is removed from said steel, and so that a finite amount of carbon remains in solution at completion of said reaction, wherein, when titanium is selected as one the nitride-forming elements, the amount satisfies the relationship $3.4N<Ti<6(N+C)$.

24. The article of claim 23 wherein said nitride-forming element is one of boron and zirconium.

25. The article of claim 23 wherein said nitride-forming element is titanium.

26. In a method of making a rolled steel article comprising the steps of casting a low carbon steel containing amounts of carbon, manganese, aluminum, nitrogen with the balance iron and incidental impurities and hot rolling said steel, the improvement comprising:

a) providing said steel with a composition consisting essentially in weight percent of:
between 0.0005 and 0.1% carbon;
between zero and less than 0.04% nitrogen;
between zero and less than 0.5% of a nitride forming element;
between zero and 0.5% aluminum;
between zero and up to 2.5% manganese;
between 0.005 and 0.6% vanadium with the balance iron and inevitable impurities, wherein said vanadium contributes to improved bake hardenability of said steel when subjected to pain baking, b) cold rolling the hot rolled steel, and c) batch annealing the cold rolled steel by slowly heating the cold rolled steel in coil form to a temperature between 1,200° F. and 1,400° F., holding the coil at said temperature for a period of time and slowly cooling said coil to ambient temperature.

27. The method of claim 26 wherein said nitride-forming element is selected from the group consisting of titanium, boron and zirconium.

28. The method of claim 27 wherein said nitride-forming element is titanium in an amount satisfying a relationship $3.4N<Ti<6(N+C)$.

29. The method of claim 26 wherein said vanadium ranges between 0.05 and 0.15%.

30. The method of claim 26 wherein bake hardenability is increased by at least 3 KSI from said vanadium addition.

31. The method of claim 26 wherein said steel consists essentially of by weight 0.0018 to 0.0028% carbon, 0.18 to 0.22% manganese, 0.024 to 0.040% aluminum, 0.0044 to 0.0065% nitrogen, 0.018 to 0.022% titanium as said nitride forming element, and 0.049 to 0.094% vanadium with the balance iron and inevitable impurities.

32. The method of claim 26 wherein said steel is coated.

33. The method of claim 32 wherein said steel is coated by hot-dipping.

34. The method of claim 32 wherein said steel is coated by electrogalvanizing.

35. The method of claim 26 wherein said steel is formed into a sheet product and subjected to a paint baking step.

36. The method of claim 26 wherein the carbon ranges between 0.0005 and 0.0028% and the vanadium ranges between 0.03 and 0.094%.

* * * * *